US005697621A

United States Patent [19]

Nazarian

[11] Patent Number: 5,697,621

[45] Date of Patent: Dec. 16, 1997

[54] STEERABLE ANIMAL STATUE FOR A CARRIAGE

[76] Inventor: Kevork Nazarian, 1062 Edgewood La., Fort Lee, N.J. 07024

[21] Appl. No.: 527,193

[22] Filed: Sep. 12, 1995

[51] Int. Cl.[6] ..... A63G 19/00

[52] U.S. Cl. ..... 280/1.165; 280/1.14; 280/1.206; 280/1.202

[58] Field of Search ..... 280/1.165, 1.14, 280/1.16, 1.186, 1.202, 1.203, 1.206, 1.208; 446/270, 297, 391; 472/98, 99

[56] References Cited

U.S. PATENT DOCUMENTS

| | | | |
|---|---|---|---|
| 922,639 | 5/1909 | Spencer | 280/1.16 |
| 2,108,868 | 2/1938 | Rumsey | 280/1.165 |
| 2,511,968 | 6/1950 | Card | 280/1.203 |
| 2,740,636 | 4/1956 | Dix | 280/1.203 |
| 3,055,672 | 9/1962 | Parks | 280/1.14 |
| 5,217,248 | 6/1993 | Reast | 280/718 |

*Primary Examiner*—Brian L. Johnson
*Assistant Examiner*—Gary Savitt
*Attorney, Agent, or Firm*—Michael I. Kroll

[57] ABSTRACT

An animal statue for simulating the drawing of a pedal-propelled or motorized carriage is provided which consists of a front section, the head of which contains a motion actuated voice box, and a rear section to be connected to the carriage to be drawn. The front section is joined to the rear section by either a coil or leaf spring. As the front section is steered to the right or to the left by reins attached to the front section, the spring resists this motion and tends to draw the front section back into alignment with the rear section thus better simulating the guiding of a horse with reins. A mechanism, such as a wheel or a caster, is coupled to each leg of the animal statue, for allowing the animal statue to travel along the ground. A structure is for steering the first travel allowing mechanism. A person in the carriage chassis can control the steering structure with a set of reins, thereby simulating the feeling of driving a real animal-drawn carriage.

4 Claims, 2 Drawing Sheets

STEERABLE ANIMAL STATUE FOR A CARRIAGE

BACKGROUND OF THE INVENTION

1. Field of the Invention

The instant invention relates generally to animal statues and more specifically it relates to a steerable animal statue for either a pedal-driven or a motorized carriage. The head of the animal statue bobs back and forth as the statue moves thus activating a motion-actuated voice box mounted in the head.

2. Description of the Prior Art

Numerous animal statues have been provided in the prior art that are adapted to be attached to pedal-propelled or motor driven wheeled conveyances to give the look and feel of a vehicle drawn by the animal. For example, U.S. Pat. No. 346,078 to Vick; U.S. Pat. No. 888,666 to Speice; U.S. Pat. No. 922,639 to Spencer; U.S. Pat. No. 1,772,794 to Arney; U.S. Pat. No. 2,125,976 to Young; U.S. Pat. No. 2,172,552 to Ruble; U.S. Pat. No. 4,546,989 Peterson; French patent 2,344,438 to Chapois; and German patent 2,347,584 to Krause all are illustrative of such prior art. While these units may be suitable for the particular purpose to which they address, they would not be as suitable for the purposes of the present invention as heretofore described.

Vick, Alfred

VELOCIPEDE

U.S. Pat. No. 346,078

A hobby-velocipede which is easily operated, constructed strong and durable, and provided with foot-cranks which may be adjusted in height, and means for adjusting the tension of the chain or band which communicates power to the axle.

Speice, Charles F.

VELOCIPEDE

U.S. Pat. No. 888,666

A velocipede which simulates a racing sulky. It is provided with means whereby it can be propelled by foot power. The propelling means is of simple, durable, and efficient character. The guiding means is designed to be operated by reins which include elastic connections whereby the steering parts are held in predetermined positions.

Spencer, John B.

WHEELED TOY

U.S. Pat. No. 922,639

A wheeled toy comprising the figure of a horse mounted upon wheels with means for attaching or hitching the horse to a cart or wagon of any description and for guiding the horse by the reins from the seat of the cart or wagon.

Arney, John W.

JUVENILE VEHICLE

U.S. Pat. No. 1,772,794

A rigid thill sulky, a close hitch and short turn vehicle or sulky, the construction having a special arrangement of the equalizing springs elevated to have greater leverage and to avoid rubbing when extended, to provide a perpendicular wheel and hinge alignment to prevent swaying, to provide a built in wheel fork and to provide a seat and thill arrangement adapting it to various leg lengths.

Young, Michael J.

CHILD'S VEHICLE

U.S. Pat. No. 2,125,976

A pedal operated tricycle type of child's vehicle having mounted in the front thereof a figure of an animal such as a horse having pivoted legs operatively connected with the pedals of the vehicle so that the animal simulates a walking movement while the vehicle is being propelled. A pivoted steering wheel is mounted in the body of the animal figure, which is also pivoted so that steering of the vehicle may be accomplished by drawing on either side of a pair of reins attached to the pivoted head and held in the hands of the operator.

Ruble, Cecil F.

TOY VEHICLE

U.S. Pat. No. 2,177,552

A wheeled vehicle which so functions, as it travels, that the rider is carried through movements akin to those experienced in riding horseback. The frame of the vehicle is of fanciful design representing an animal, preferably a horse. Pedals are provided whereby the vehicle is propelled.

Peterson, Arthur G.

TOY ANIMAL VEHICLE

U.S. Pat. No. 4,546,989

A toy animal vehicle for riding by a child, having a mainframe structure with a seat supported by struts and a forward tongue member. A pair of rear wheels are mounted on an axle journaled in the struts. A substantially hollow contoured animal body of organic plastic material embraces at least the forward part of the tongue and has a transverse slot through its upper wall and an upwardly directed knob projecting from its upper wall. The steering mechanism has a steerable post in the forward end of the tongue, with a wheel in a forked member below the tongue member and a lateral crossbar member on the post above the tongue. Handle-bars on the knob of the animal body, and a pair of laterally spaced connecting rods extending from the crossbar through the transverse slot to the handlebars accomplish positive steering.

Chapois, Marcel, Jean Joseph

PEDAL PROPELLED VEHICLE

French Patent Number 2,344,438

A pedal propelled vehicle with a representation of an animal. The rear wheels thereof are independently driven by chains and its front wheels steered by reins.

Krause, Ulrich

PEDAL DRIVEN CHILD'S TRICYCLE TOY

German Patent Number 2,347,584

A pedal propelled vehicle with a representation of a horse. The vehicle has a rigid and a steerable axle, one of which has a drive consisting of a lever transmission. The seat is positioned on a carriage, connected via a frame to the steerable axle. The axle is turned via a remote control operated from the seat. The drive consists of two pedals, rigidly connected to a chain wheel. The chain wheel is connected via a chain to a sprocket fastened to the axle. The axle has two wheels and the remote control is formed as a cable connected via levers to the steerable axle.

SUMMARY OF THE INVENTION

The instant invention is a four legged animal statue with two sections, a front section and a rear section. The two legs of the front section and the two legs of the rear section can ride on either casters or rollers of the type found on roller skates. The front section is joined to the rear section by at least one sturdy spring of the coil or leaf type. This eliminates the need for a hinge to join the two sections, and greatly simplifies the construction over the prior art. Due to the stiffness of the spring(s) joining the front and rear sections of the animal, the front section of the animal tends to return to a neutral position after being steered to the right or the left by reins attached to the front section of the animal. The upper portion of the neck to which the head of the animal is attached is supported on the animal's lower neck in such a way that as the upper neck portion bobs back and forth, a motion actuated audio source mounted in the upper portion of the neck or head makes the characteristic sounds of that animal.

A primary object of the present invention, therefore, is to provide an animal statue for a carriage in order to simulate an animal drawing the carriage. The animal statue is to be pushed by and provide the steering for either a pedal-propelled or motorized vehicle that will overcome the shortcomings of the prior art devices.

Another object is to provide a horse statue for use with a motorized carriage, in which a person will enjoy giving themselves a sense of country living in a suburban atmosphere.

An additional object is to provide an animal statue for a motorized carriage, that a person can operate and steer with a set of reins, thus simulating for the person the feeling of driving a real animal-drawn carriage.

A further object is to provide an animal statue whose front and rear portions are joined in such a manner as to give a more realistic rein-feel to the person driving the invention.

Another object is to provide an animal statue which makes animal-like sounds (whinnies or roars, snorts, pawing the earth, etc.) when it is moved.

A further object is to provide an animal statue that is simple and easy to use with a carriage.

A still further object is to provide an animal statue for use with either a pedal-propelled or motorized carriage that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims. Although the drawings show a horse statue, any animal can be used and still be encompassed within the scope of this invention. Hence this invention can be practiced with a wide diversity of statues such as statues of various kinds of horses, oxen, lions, tigers—in short, any animal that generally walks on four legs.

BRIEF DESCRIPTION OF THE DRAWING FIGURES

DETAILED DESCRIPTION OF THE PREFERRED EMBODIMENTS

Figure 1:
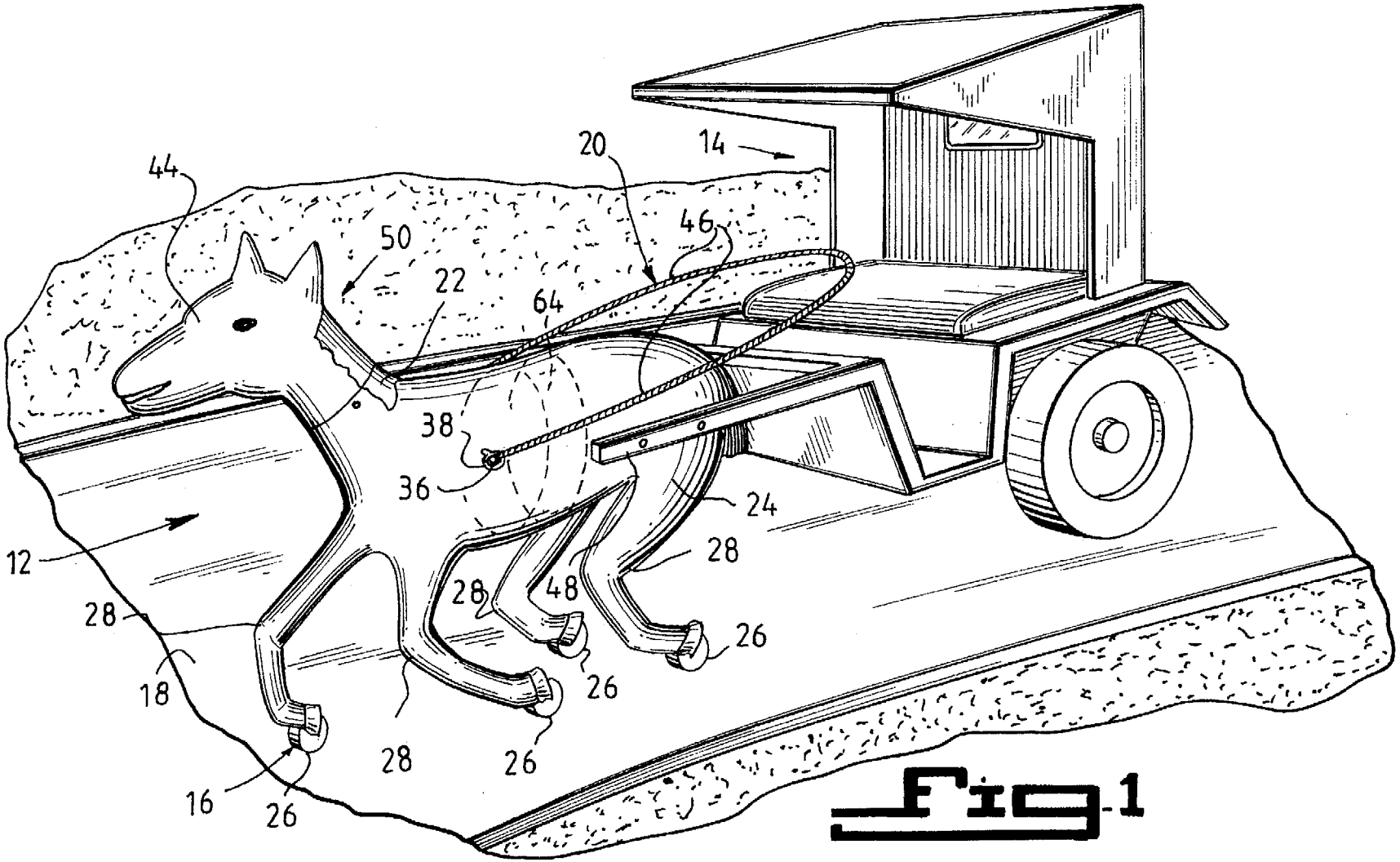
FIG. 1 is a front perspective view of the instant invention being used to simulate the drawing of a carriage.
Figure 2:
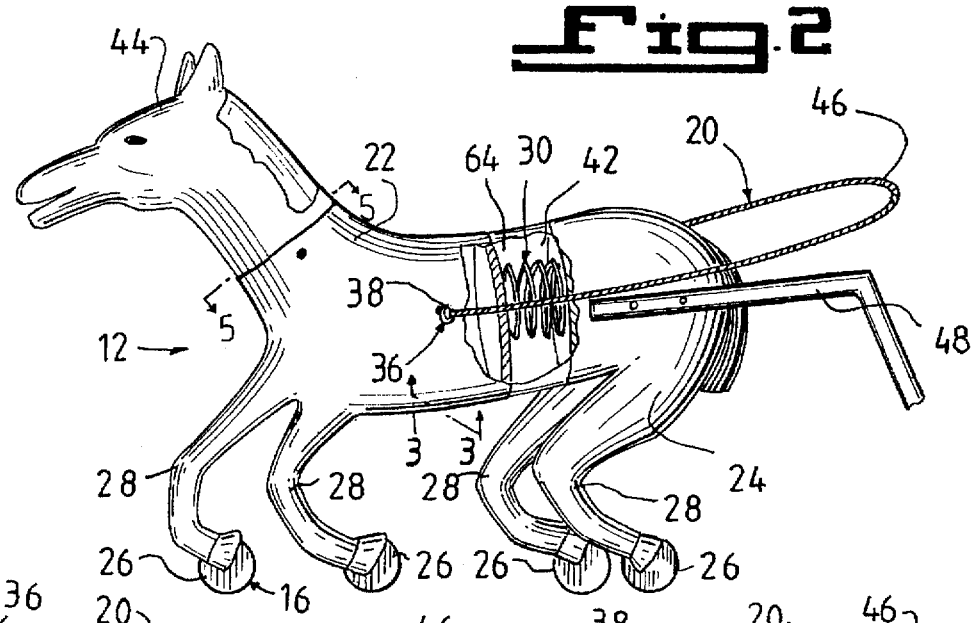
FIG. 2 is a side elevation view of the instant invention with parts broken away to reveal a spring joining the front and rear sections of the horse.

Turning now descriptively to the drawings, in which similar reference characters denote similar elements throughout the several views, the Figures illustrate an animal statue 12 simulating the drawing of a carriage chassis 14. The chassis which may be pedal-propelled or motorized is coupled behind the animal statue 12. A travel allowing mechanism 16 is coupled to the animal statue 12, for allowing the animal statue 12 to travel along the ground 18. The animal statue 12 consists of a front section 22 and a rear section 24. A steering structure 20 is for steering the travel allowing mechanism 16. A person in the carriage chassis 14 can control the steering structure 20, thereby simulating the feeling of driving a real animal-drawn carriage.

The travel allowing mechanism 16 consists of casters or rollers 26 of the type found on roller skates attached to each of the legs 28 of the animal statue 12.

Figure 3:
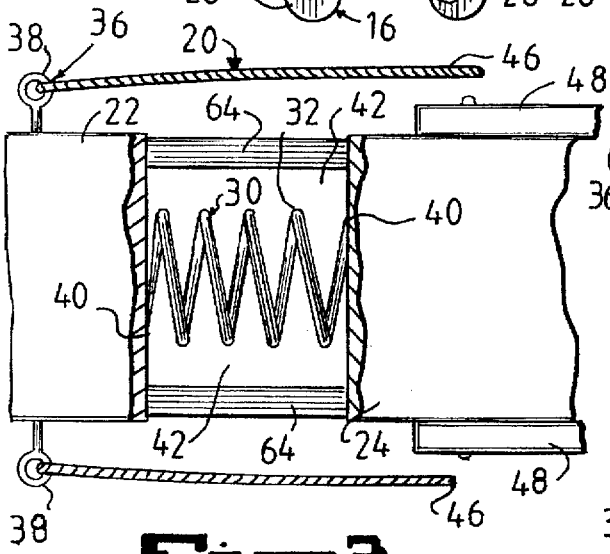
FIG. 3 is a cross sectional view with parts broken away taken on the line 3—3 of FIG. 2 showing two sections of the horse joined with a coil spring.
Figure 4:
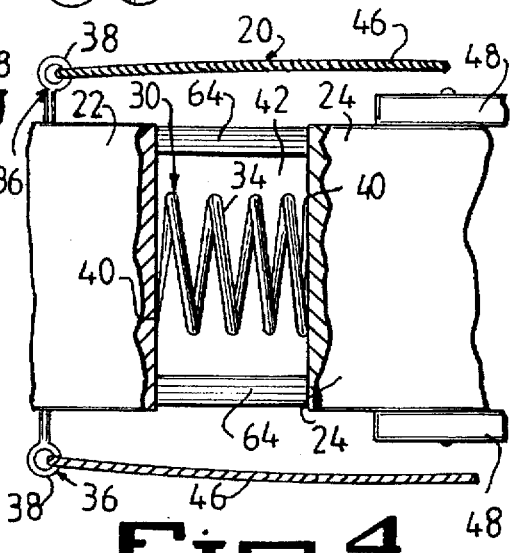
FIG. 4 is a cross sectional view with parts broken away taken on the line 3—3 of FIG. 2 but showing two sections of the horse joined by a leaf spring instead of by a coil spring.

The front section 22 of the horse statue is connected to the rear section 24 of the horse statue 12 by a spring 30 of either the coil or the leaf 34 type as is shown in FIGS. 3 and 4 respectively. On either side of the front section 22 and extending outward therefrom are two connectors 36 such as eyeholes 38. Preferably, the places 40 where the spring 30 is connected to the front and rear sections 22, 24 of the animal statue 12 are in the same horizontal plane. And the eyeholes 38 on either side of the front section 22 of the animal statue 12 are in substantially the same horizontal plane as the locations 40 where the spring 30 is attached to the front and rear sections 22, 24 of the animal statue 12. Preferably, the region 42 surrounding the spring between the front and rear sections 22, 24 of the animal statue 12 is partially filled with a sturdy but soft and flexible material 64. An example of such a material is a rubberlike foam such as those foams comprising polyurethane, ether, and ester.

The steering structure 20 includes rein attachment eyeholes 38, 38 attached to and extending out from the sides of the front section 22 of the animal statue 12. These rein attachment eyeholes 38, 38 extend outward sufficiently from the sides of the front section 22 of the animal statue 12 that the front section 22 of the animal statue 12 can be easily steered to the right or left by pulling on one or the other of the reins 46 which are attached to the rein attachment eyeholes 38 and extend back to the carriage chassis 14. Hence, when a person pulls a right portion of the rein 46 the front section 22 of the animal statue 12 will turn to the right. When the person pulls a left portion of the rein 46 the front section 22 will then turn to the left.

The spring 30 which can be either of the coil type 32 or the leaf type 34 is selected to have sufficient stiffness that the tendency of the spring to return to its original position after having been bent to the right or the left suggests an animal turning the front portion of its body back to its original position after making a turn. Preferably, the soft and sturdy but flexible material 64 which partially fills the region 42 between the front and rear sections of the animal statue is selected to further suggest the front portion of the animal's body returning to its original position and to inhibit any possible tendency of the front portion of the animals body to tip with respect to the rear portion of the animal's body.

As is shown in FIGS. 1 through 4, the carriage chassis 14 contains a pair of horizontal shafts 48, 48, extending therefrom to connect to opposite sides of the rear section 24 of animal statue 12.

Figure 5:
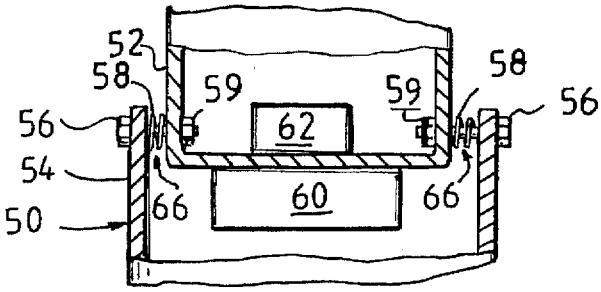
FIG. 5 is a cross sectional view taken in direction of arrow 5 in FIG. 2 showing the mechanism by which the head of the statue is joined to the neck and showing a motion actuated voice box therein.

As is shown in FIG. 5, the upper portion 52 of the neck 50 fits into the lower portion 54 of the neck 50 and is rotatably connected to it by a plurality of bolts 56. In the region between the two portions of the neck 66, the bolts 56 hold springs 58 under compression. As the bolts 56 are tightened, the springs 58 are brought under further compression, thus inhibiting the movement of the upper portion of the neck 52 (to which the animal statue's head 44 is attached) with respect to the lower portion of the neck 54. When the bolts 56 are loosened, the upper portion 52 of the neck can more freely move with respect to the lower portion 54 of the neck.

Fixedly attached to the bottom surface of the upper portion 52 of the neck is weight 60. Weight 60 is chosen to be sufficiently heavy that when the animal statue is at rest, the weight of the upper portion 52 of the neck 50 and head 44 is more than counterbalanced by the weight 60, and the upper portion of the neck 50 and head 44 remain in an upright position. When the animal statue 12 is moved, however, the weight will rock back and forth, thus causing the upper portion of the neck 50 and head 44 to bob back and forth. Residing within the upper portion of the neck is a motion-actuated voice box 62 which emits the sounds of an animal (pawing of hoofs, roars, whinnies, etc.) when it is subjected to movement. Voice boxes of this kind are well known in the art and can be obtained from the following companies:

1) A.G.C., 329-T Old Courthouse Road, New Hyde Park, N.Y. 11040
2) National Artcraft Company, 23456 Mercantile Road, Beachwood, Ohio 44122
3) Racom Product Inc., 5504 State Road, Dept TR, Cleveland, Ohio
4) Flexible Flyer Co., 100 Tube Avenue, West Point, Miss. 39773

The animal statue 12 as shown in the drawings is a horse, but other types of animal statues can also be utilized, such as but not limited to, a donkey, a mule, a bison and a camel.

LIST OF REFERENCE NUMBERS

10 carriage
12 animal statue
14 carriage chassis
16 first travel allowing mechanism
18 ground
20 steering structure
22 front section of animal statue
24 rear section of animal statue
26 roller or caster
28 leg of animal statue
30 spring
32 coil spring
34 leaf spring
36 connector
38 rein attachment eyehole
40 location where spring 30 is connected to a section of the animal statue
42 region surrounding spring 30
44 head of animal statue
46 rein
48 horizontal shaft on 14
50 neck
52 upper portion of neck
54 lower portion of neck
56 bolt
58 spring
59 nut
60 weight
62 motion-actuated voice box
64 soft, sturdy, flexible material
66 region between two portions of neck It will be understood that each of the elements described above, or two or more together may also find a useful application in other types of devices differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An animal statue for simulating the drawing of a carriage chassis comprising:

a) a front section of said animal statue comprising a head, a neck, a front portion of a torso of said animal, and two legs extending down from said torso;

b) said neck being made up of an upper neck and a lower neck, said upper neck extending into said lower neck, and means connecting said upper neck to said lower neck for permitting said upper neck to be movable with respect to said lower neck including weight means mounted on the bottom of said upper neck within said lower neck to cause said upper neck and head to rock to and fro when said animal statue is moving, and motion actuated voice box means in said upper neck to emit characteristic sounds of said animal when said statue is moving;

c) a rear section of said animal statue comprising a rear portion of said torso, two legs extending down from said rear portion, and means connecting said front and rear sections together to permit said front section to be moved sideways with respect to said rear section for steering said animal statue, said connecting means including a spring joining said front and rear sections for returning the front section to its normal position when said animal statue is not being steered and a bendable outer surface enclosing said spring for joining the front and rear portions of the torso;

d) movement means on the bottom of the legs of said animal statue to permit said animal statue to move freely;

e) means for steering said animal statue comprising an eyehole on each side of the front section of said torso and a rein extending from each said eyehole back to the rear of said animal statue, said eyeholes being in the same horizontal plane as said spring, so that pulling on one of said reins will turn the front section of said torso in the direction the animal statue is to be moved; and f) a carriage connected to the rear of said animal statue, said carriage including means for providing travel movement for said animal statue and carriage.

2. The animal statue of claims 1 which said movement means are wheels.

3. The animal statue of claim 1 in which said movement means are casters.

4. The animal statue of claim 1 in which said spring is a coil spring.

* * * * *